US007198500B1

(12) United States Patent
Lin

(10) Patent No.: US 7,198,500 B1
(45) Date of Patent: Apr. 3, 2007

(54) NON-DETACHABLE BULB ADAPTER FOR AN ENERGY SAVING BULB

(76) Inventor: Chia-Kuan Lin, 4F, No. 50, Sanmin Rd., Lujhou City, Taipei Hsien (TW)

( * ) Notice: Subject to any disclaimer, the term of this patent is extended or adjusted under 35 U.S.C. 154(b) by 0 days.

(21) Appl. No.: 11/390,570

(22) Filed: Mar. 28, 2006

(51) Int. Cl.
*H01R 13/62* (2006.01)

(52) U.S. Cl. ..... 439/300; 439/226; 439/318; 362/226

(58) Field of Classification Search ..... 439/226, 439/308, 300, 336, 339, 304, 318, 257
See application file for complete search history.

(56) References Cited

U.S. PATENT DOCUMENTS 992,084 A * 5/1911 Trulock ..... 439/300
4,183,604 A * 1/1980 Tjornhom, Sr. ..... 439/300
6,318,881 B1 * 11/2001 Lawrence ..... 362/650
6,494,730 B1 * 12/2002 Yan ..... 439/226

* cited by examiner

*Primary Examiner*—Truc Nguyen
(74) *Attorney, Agent, or Firm*—Alan D. Kamrath; Nikolai & Mersereau, P.A.

(57) ABSTRACT

A non-detachable bulb adapter for an energy saving bulb has a base, a casing, a cover and a unidirectional lock. The casing is mounted on the base and has a mounting slot defined longitudinally through the casing. The cover covers the casing and has an outer thread and an opening defined radially through the cover. The unidirectional lock is flexible, is mounted on the casing and the cover and has a mounting tab mounted through the mounting slot and the opening and a locking tab protruding out from the mounting tab and extending out of the opening of the cover. The structure of the non-detachable bulb adapter is simple so that non-detachable bulb adapter has a high production rate and a low cost.

4 Claims, 3 Drawing Sheets

NON-DETACHABLE BULB ADAPTER FOR AN ENERGY SAVING BULB

BACKGROUND OF THE INVENTION

1. Field of the Invention

The present invention relates to an adapter, and more particularly to a non-detachable bulb adapter that prevents people from detaching the non-detachable bulb adapter out of an incandescent bulb socket and has a high production rate and a low cost.

2. Description of Related Art

Energy saving bulbs such as fluorescent bulbs saves more energy than incandescent bulbs. However, bulb sockets for the energy saving and incandescent bulbs are different and cannot be exchanged.

An energy saving bulb is used with an energy saving bulb socket. The energy saving bulb socket has two curved slots defined through the energy saving bulb socket. Each curved slot has an inlet hole and a locking hole smaller than the inlet hole. The energy saving bulb has a body and a mount. The mount is mounted to the body and has two mounting legs. The mounting legs extend out from the mount and each mounting leg has a distal end and an enlarged locking element. The enlarged locking element is formed on the distal end, is smaller than the inlet hole and is larger than the locking hole of each curved slot. Extending the mounting legs through the inlet holes in curved slots and then rotating the energy saving bulb relative to the energy saving bulb socket cause the enlarged blocking elements to be locked in the locking hole.

The incandescent bulb socket has a threaded mounting hole. The incandescent bulb has a body and a threaded mounting head corresponding to a threaded mounting hole in the incandescent bulb socket.

However, most lamps are equipped with an incandescent bulb socket instead of an energy saving bulb socket. Therefore, a bulb adapter to be installed to the incandescent bulb and to receive the energy saving bulb is developed so that people can mount the energy saving bulb on a lamp through the bulb adapter. To avoid that people inadvertently detach the bulb adapter when detaching the energy saving bulb and reinstall an incandescent bulb to the lamp, the bulb adapter has a lock, a spring and a rail to permanently lock the bulb adapter in the lamp. However, the arrangement of the lock, spring and rail is complicated. Therefore, the bulb adapter has a low production rate and a high cost.

To overcome the shortcomings, the present invention provides a non-detachable bulb adapter for an energy saving bulb to mitigate or obviate the aforementioned problems.

SUMMARY OF THE INVENTION

The main objective of the invention is to provide a non-detachable bulb adapter that prevents people from detaching the non-detachable bulb adapter out of an incandescent bulb socket and has a high production rate and a low cost.

A non-detachable bulb adapter for an energy saving bulb in accordance with the present invention comprises a base, a casing, a cover and a unidirectional lock.

The casing is mounted on the base and has a mounting slot defined radially through the casing.

The cover covers the casing and has an outer thread and an opening defined longitudinally through the cover.

The unidirectional lock is flexible, is mounted on the casing and the cover and has a mounting tab mounted through the mounting slot and the opening and a locking tab protruding out from the mounting tab and extending out of the opening of the cover.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
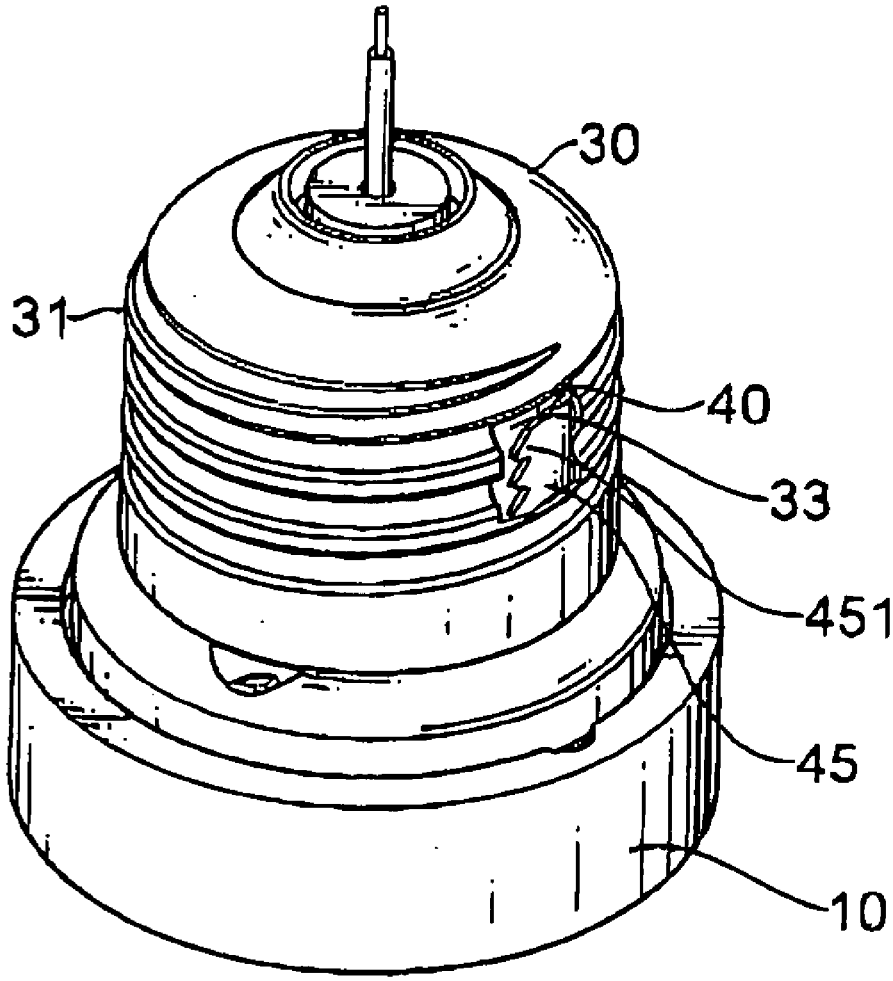
FIG. 1 is a perspective view of a non-detachable bulb adapter for an energy saving bulb in accordance with the present invention.
Figure 2:
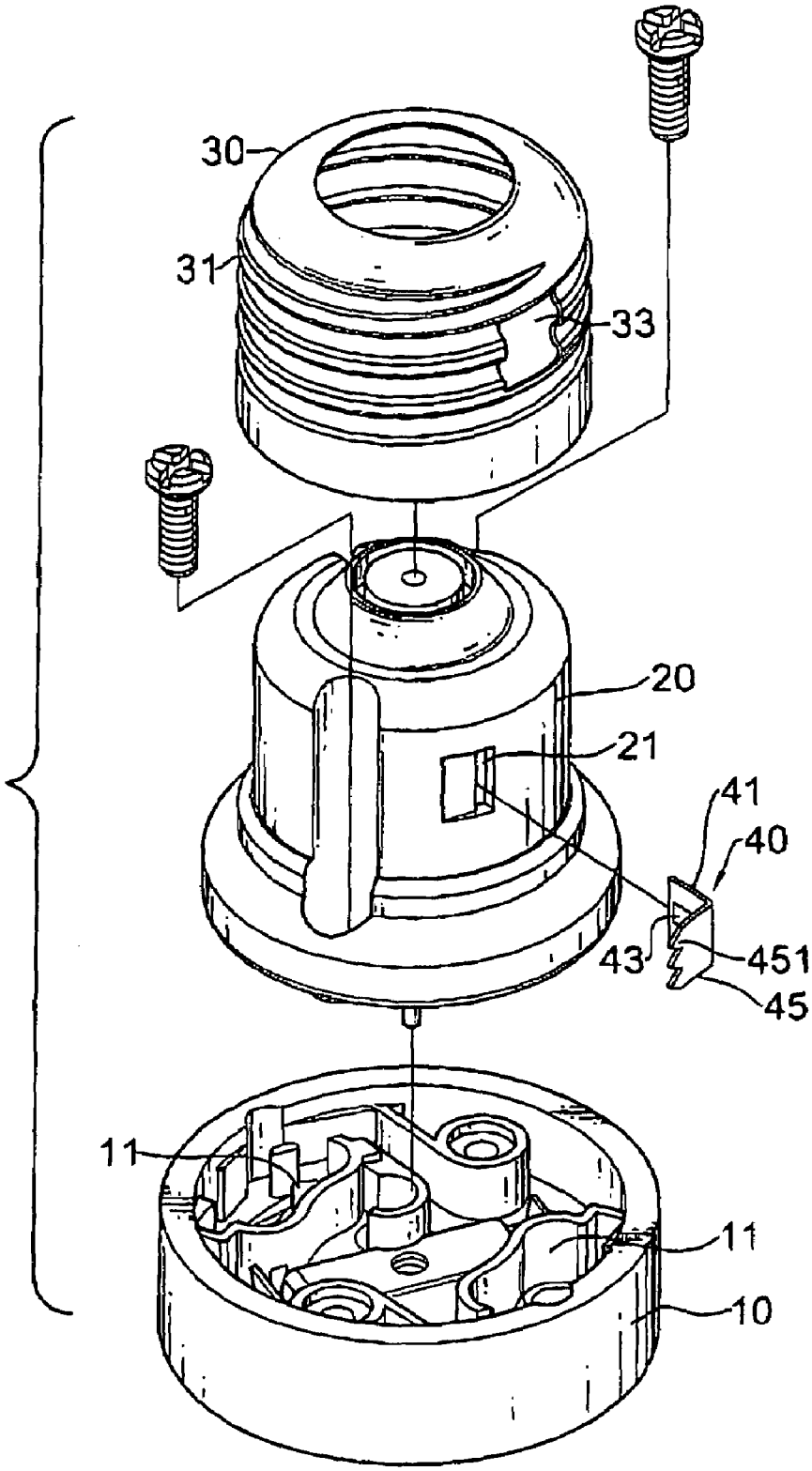
FIG. 2 is an exploded perspective view of the non-detachable bulb adapter in FIG. 1.

With reference to FIGS. 1 and 2, a non-detachable bulb adapter in accordance with the present invention is mounted to an incandescent bulb socket and holds an energy saving bulb. The incandescent bulb socket comprises a threaded mounting hole having an inner surface. The energy saving bulb comprises a body and a mount. The mount is mounted to the body and has two mounting legs. The mounting legs extend out from the mount and each mounting leg has a distal end and an enlarged locking element.

The non-detachable bulb adapter is mounted to the mount, receives the mounting legs of the energy saving bulb and comprises a base (10), a casing (20), a cover (30) and a unidirectional lock (40).

Figure 4:
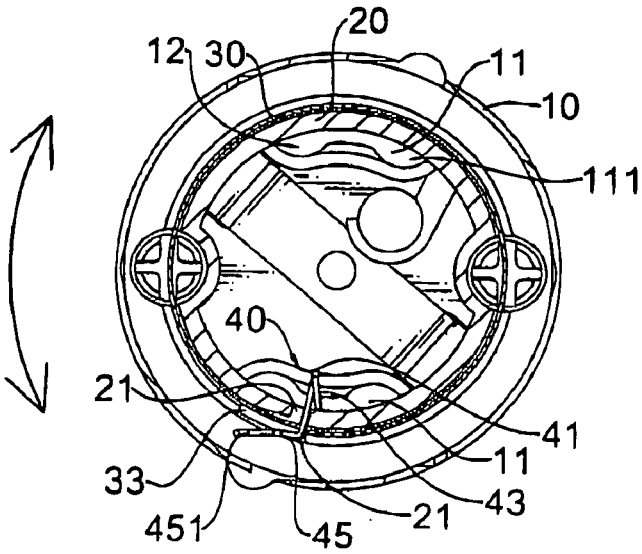
FIG. 4 is a cross sectional top view of the non-detachable bulb adapter along line 4—4 in FIG. 3.

With further reference to FIG. 4, the base-(10) may be annular, may receive the energy saving bulb and has a top, a bottom two curved slots (11). The curved slots (11) are defined through the base (10) and each curved slot (11) has two ends, an inlet hole (111) and an locking hole (112). The inlet and locking holes (111, 112) are defined respectively at the ends of the curved slot (11), the inlet hole (111) is larger than the enlarged locking element and the locking hole (112) is smaller than the enlarged locking element. Therefore, the enlarged locking elements can extend through the inlet holes (111) from the bottom to the top of the base (10) and be locked in the locking holes (112) to securely hold the energy saving bulb in the base (10).

The casing (20) is hollow and cylindrical, is made of insulating material, is mounted on the top of the base (10) and has an inner surface and a mounting slot (21). The mounting slot (21) is defined longitudinally through the casing (20).

The cover (30) is annular, is made of conductive material such metal, is mounted securely on and covers the casing (20) and has an outer surface, an outer thread (31) and an opening (33). The outer thread (31) is formed on the outer surface of the cover (30), corresponds to the threaded mounting hole of the incandescent bulb socket and may be a right-hand thread shown in FIGS. 1 and 3 or a left-hand thread. The opening (33) is defined radially through the cover (30) and has a dimension.

Figure 3:
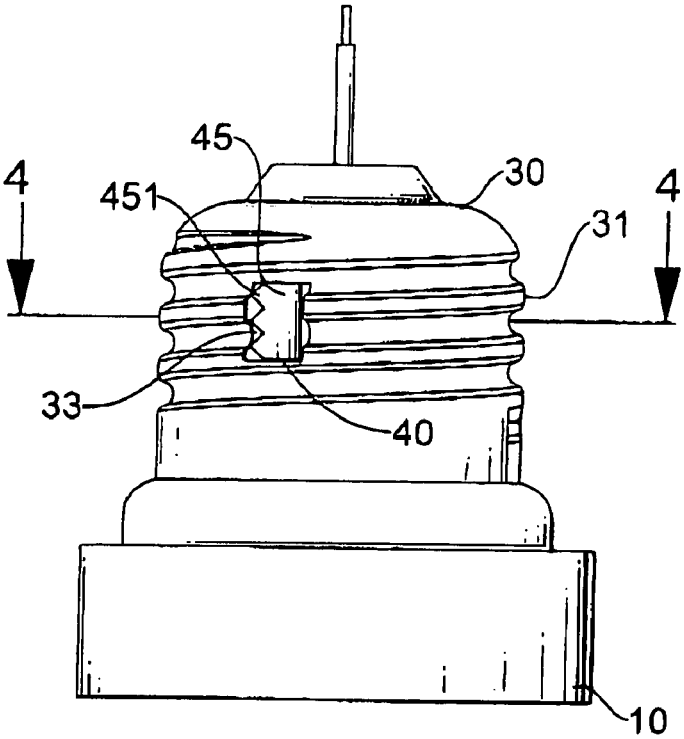
FIG. 3 is a side view of the non-detachable bulb adapter in FIG. 1.

With reference to FIGS. 3 and 4, the unidirectional lock (40) is flexible, is mounted on the casing (20) and the cover (30) and has a mounting tab (41), a retaining tab (43) and a locking tab (45).

The mounting tab (41) is mounted through the mounting slot (21) in the casing (20) and the opening (33) in the cover (30) and has an inside end and an outside end.

The retaining tab (43) is inclined and extends out from the mounting tab (41) and has a distal end presses against the inner surface of the casing (20).

The locking tab (45) is inclined and protrudes out from the outside end of the mounting tab (41) and extends out of the opening (33) of the cover (30) in a direction (D) in which the cover (30) screws to fasten the non-detachable bulb adapter onto the incandescent bulb socket. In other word, the direction (D) in which the locking tab (45) extends departs from a reverse direction in which the cover (30) unscrews to unfasten the non-detachable bulb adapter out of the incandescent bulb socket. The direction in which the locking tab (45) extends is reversed while the outer thread (33) is a left-hand thread. The locking tab (45) has a distal end, a dimension and may have multiple teeth (451). The dimension of the locking tab (45) is equal to or smaller than that of the opening (33) in the cover (30) so the locking tab (45) can be bent into completely the opening (33). The teeth (451) extend straight out from the distal end.

The locking tab (45) is bent in the opening (33) in the cover (30) and slides on the inner surface of the threaded mounting hole while the non-detachable bulb adapter is screwed on the incandescent bulb socket. Alternatively, the teeth (451) on the locking tab (45) tightly presses against the inner surface of the threaded mounting hole and securely locks the cover (30) in the threaded mounting hole while someone tries to unscrew the non-detachable bulb adapter out of the incandescent bulb socket.

The structure of the non-detachable bulb adapter is simple so that non-detachable bulb adapter has a high production rate and a low cost.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A non-detachable bulb adapter for an energy saving bulb comprising:

a base adapted for receiving the energy saving bulb and having a top;

a casing being hollow and cylindrical, mounted on the top of the base and having an inner surface and a mounting slot defined longitudinally through the casing;

a cover being annular, mounted securely on and covering the casing and having an outer surface, an outer thread formed on the outer surface of the cover and an opening defined radially through the cover, and a unidirectional lock being flexible, mounted on the casing and the cover and having a mounting tab mounted through the mounting slot in the casing and the opening in the cover and having an inside end and an outside end;

a retaining tab inclined and extending out from the mounting tab and having a distal end pressing against the inner surface of the casing; and a locking tab inclined and protruding out from the outside end of the mounting tab and extending out of the opening of the cover in a direction in which the cover screws to fasten the non-detachable bulb adapter.

2. The non-detachable bulb adapter as claimed in claim 1, wherein the locking tab of the unidirectional lock has a distal end and multiple teeth extending straight out from the distal end.

3. The non-detachable bulb adapter as claimed in claim 2, wherein a dimension of the locking tab is smaller than a dimension of the opening in the cover.

4. The non-detachable bulb adapter as claimed in claim 3, wherein the casing is made of insulating material and the cover is made of conductive material.

* * * * *